US006496155B1

(12) United States Patent
Sievenpiper et al.

(10) Patent No.: US 6,496,155 B1
(45) Date of Patent: Dec. 17, 2002

(54) END-FIRE ANTENNA OR ARRAY ON SURFACE WITH TUNABLE IMPEDANCE

(75) Inventors: Daniel Sievenpiper, Los Angeles, CA (US); Jar Jar Lee, Irvine, CA (US); Stan Livingston, Fullerton, CA (US)

(73) Assignees: HRL Laboratories, LLC., Malibu, CA (US); Raytheon Company, Lexington, MA (US)

( * ) Notice: Subject to any disclaimer, the term of this patent is extended or adjusted under 35 U.S.C. 154(b) by 0 days.

(21) Appl. No.: 09/537,921

(22) Filed: Mar. 29, 2000

(51) Int. Cl.[7] ..... H01Q 11/10

(52) U.S. Cl. ..... 343/770; 343/754; 343/756; 343/792.5

(58) Field of Search ..... 343/700 MS, 754, 343/756, 767, 770, 909, 792.5, 853; H01Q 11/10

(56) References Cited

U.S. PATENT DOCUMENTS

| | | | | |
|---|---|---|---|---|
| 3,267,480 A | | 8/1966 | Lerner | 343/911 |
| 3,810,183 A | * | 5/1974 | Krutsinger et al. | 343/708 |
| 4,150,382 A | | 4/1979 | King | 343/754 |
| 4,266,203 A | | 5/1981 | Saudreau et al. | 333/21 |
| 4,594,595 A | * | 6/1986 | Struckman | 343/770 |
| 4,749,996 A | * | 6/1988 | Tresselt | 343/700 MS |
| 4,843,403 A | | 6/1989 | Lalezari et al. | 343/767 |
| 4,853,704 A | | 8/1989 | Diaz et al. | 343/767 |
| 4,905,014 A | | 2/1990 | Gonzalez et al. | 343/909 |
| 5,021,795 A | | 6/1991 | Masiulis | 343/700 |
| 5,023,623 A | * | 6/1991 | Kreinheder et al. | 343/725 |
| 5,081,466 A | | 1/1992 | Bitter, Jr. | 343/767 |
| 5,115,217 A | | 5/1992 | McGrath et al. | 333/246 |
| 5,158,611 A | | 10/1992 | Ura et al. | 106/499 |
| 5,268,701 A | | 12/1993 | Smith | 343/767 |
| 5,519,408 A | | 5/1996 | Schnetzer | 343/767 |
| 5,531,018 A | | 7/1996 | Saia et al. | 29/622 |
| 5,541,614 A | | 7/1996 | Lam et al. | 343/792.5 |
| 5,557,291 A | * | 9/1996 | Chu et al. | 343/725 |
| 5,589,845 A | | 12/1996 | Yandrofski et al. | 343/909 |

(List continued on next page.)

FOREIGN PATENT DOCUMENTS

| | | | |
|---|---|---|---|
| EP | 0 539 297 | 4/1993 | |
| FR | 2 785 476 | 5/2000 | |
| GB | 2 281 662 | 3/1995 | |
| GB | 2 328 748 | 3/1999 | |
| WO | WO 99/50929 | 10/1999 | H01Q/1/38 |

OTHER PUBLICATIONS

Balanis, C., "Aperture Antennas", *Antenna Theory, Analysis and Design*, 2nd Edition, (New York, John Wiley & Sons, 1997), Chap. 12, pp. 575–597.

Balanis, C., "Microstrip Antennas", *Antenna Theory, Analysis and Design*, 2nd Edition, (New York, John Wiley & Sons, 1997), Chap. 14, pp. 722–736.

Cognard, J., "Alignment of Nematic Liquid Crystals and Their Mixtures" *Mol. Cryst. Lig, Cryst*. Suppl. 1, 1 (1982) pp. 1–74.

Doane, J.W., et al., "Field Controlled Light Scattering from Nematic Microdroplets", *App. Phys. Lett.*, vol. 48 (Jan. 1986) pp. 269–271.

Jensen, M.A., et al., "EM Interaction of Handset Antennas and a Human in Personal Communications", *Proceedings of the IEEE*, vol. 83, No. 1 (Jan. 1995) pp. 7–17.

(List continued on next page.)

*Primary Examiner*—Tho Pham
(74) *Attorney, Agent, or Firm*—Ladas & Parry

(57) ABSTRACT

A steerable antenna and method of steering a radio frequency wave received by and/or transmitted from the antenna. The antenna includes a tunable high impedance surface and at least one end-fire antenna disposed on said surface. The method includes varying the impedance of the tunable high impedance surface.

68 Claims, 6 Drawing Sheets

U.S. PATENT DOCUMENTS

| | | | | |
|---|---|---|---|---|
| 5,611,940 | A | 3/1997 | Zettler | 73/514 |
| 5,638,946 | A | 6/1997 | Zavracky | 200/181 |
| 5,721,194 | A | 2/1998 | Yandrofski et al. | 505/210 |
| 5,923,303 | A | 7/1999 | Schwengler et al. | 343/853 |
| 5,949,382 | A | 9/1999 | Quan | 343/767 |
| 6,054,659 | A | 4/2000 | Lee et al. | 200/181 |
| 6,057,485 | A | 6/2000 | Lilly et al. | 343/700 |
| 6,154,176 | A | 11/2000 | Fathy et al. | 343/700 |
| 6,166,705 | A | 12/2000 | Mast et al. | 343/853 |
| 6,175,337 | B1 * | 1/2001 | Jasper et al. | 343/770 |
| 6,246,377 | B1 | 6/2001 | Aiello et al. | 343/770 |

OTHER PUBLICATIONS

Jensen, M.A., et al., "Performance Analysis of Antennas for Hand–held Transceivers using FDTD", *IEEE Transactions on Antennas and Propagation*, vol. 42, No. 8 (Aug. 1994) pp. 1106–1113.

Ramo, S., et al., *Fields and Waves in Communication Electronics*, 3rd Edition (New York, John Wiley & Sons, 1994) Section 9.8–9.11, pp. 476–487.

Sievenpiper, D., et. al., "High–Impedance Electromagnetic Surfaces with a Forbidden Frequency Band", *IEEE Transactions on Microwave Theory and Techniques*, vol. 47, No. 11, (Nov. 1999) pp. 2059–2074.

Sievenpiper, D., "High–Impedance Electromagnetic Surfaces", *Ph.D. Dissertation*, Dept. of Electrical Engineering, University of California, Los Angeles, CA, 1999.

Wu, S.T., et al., "High Birefringence and Wide Nematic Range Bis–tolane Liquid Crystals", *Appl. Phys. Lett.* vol. 74, No. 5, (Jan. 1999) pp. 344–346.

Ellis, T. J. and G. M. Rebeiz, "MM–Wave Tapered Slot Antennas on Micromachined Photonic Bandgap Dielectrics," 1996 *IEEE MTT–S International Microwave Symposium Digest*, vol. 2, pp. 1157–1160 (1996).

Linardou, I., et al., "Twin Vivaldi antenna fed by coplanar waveguide," *Electronics Letters*, vol. 33, No. 22, pp. 1835–1837 (Oct. 23, 1997).

Schaffner, J. H., et al., "Reconfigurable Aperture Antennas Using RF MEMS Switches for Multi–Octave Tunability and Beam Steering," *IEEE*, pp. 321–324 (2000).

Sievenpiper, D., et al., "Low–profile, four–sector diversity antenna on high–impedance ground plane," *Electronics Letters*, vol. 36, No. 16, pp. 1343–1345 (Aug. 3, 2000).

Sievenpiper, D. and Eli Yablonovitch, "Eliminating Surface Currents with Metallodielectric Photonic Crystals," 1998 *IEEE MTT–S International Microwave Symposium Digest*, vol. 2, pp. 663–666 (Jun. 7, 1998).

* cited by examiner

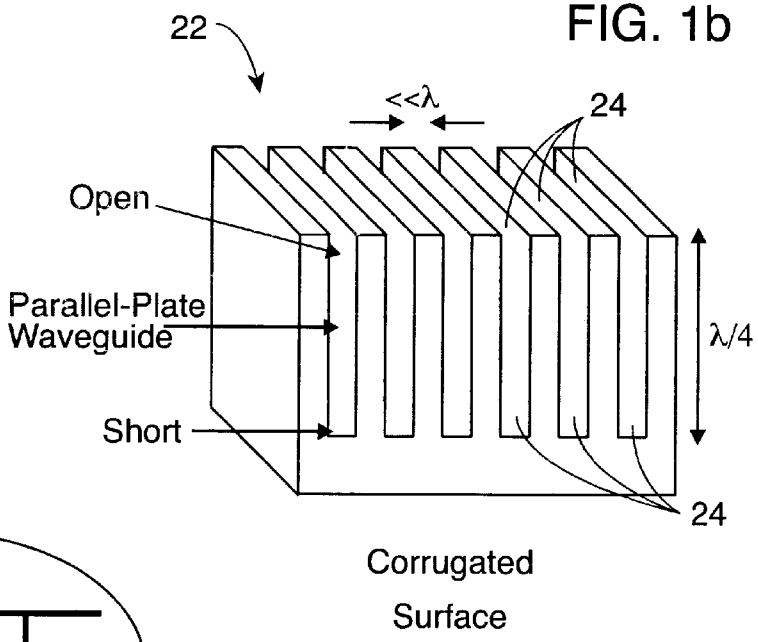
FIG. 1b
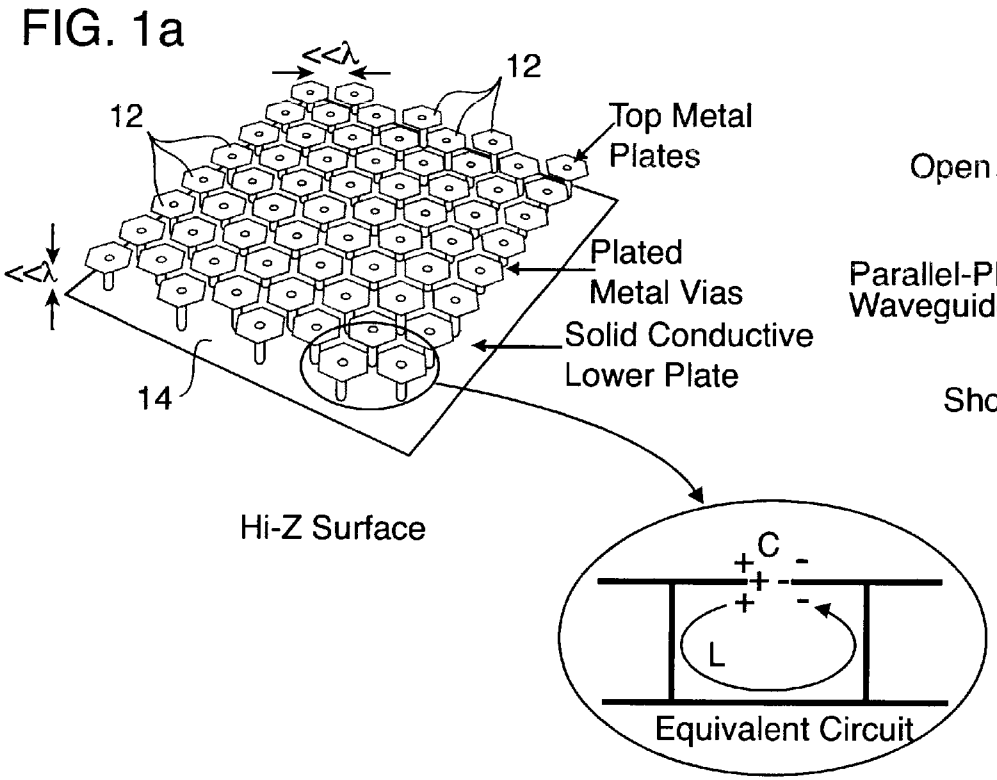
FIG. 1a
FIG. 1c

END-FIRE ANTENNA OR ARRAY ON SURFACE WITH TUNABLE IMPEDANCE

The present application is related to U.S. patent application Ser. No. 09/537,923 entitled "A Tunable Impedance Surface" filed Mar. 29, 2000 and to U.S. patent application Ser. No. 09/537,922 entitled "An Electronically Tunable Reflector" filed Mar. 29, 2000, the disclosures of which are hereby incorporated herein by this reference.

TECHNICAL FIELD

The present invention relates to conformable, flush-mounted antenna which produces end-fire radiation along the surface, and which is steerable in one or two dimensions.

BACKGROUND OF THE INVENTION AND BRIEF DESCRIPTION

The prior art includes a pending application of D. Sievenpiper, E. Yablonovitch, "Circuit and Method for Eliminating Surface Currents on Metals" U.S. provisional patent application, serial No. 60/079,953, filed on Mar. 30, 1998 which relates to a high-impedance or Hi-Z surface.

It is also known in the prior art to place a conformable end-fire antenna or array on a Hi-Z surface. It has been shown that the Hi-Z material can allow flush-mounted antennas to radiate in end-fire mode, with the radiation exiting the surface at a small angle with respect to the horizon.

The Hi-Z surface, which is the subject matter of U.S. patent application serial No. 60/079,953 and which is depicted in FIG. 1*a*, includes an array of resonant metal elements 12 arranged above a flat metal ground plane 14. The size of each element is much less than the operating wavelength. The overall thickness of the structure is also much less than the operating wavelength. The presence of the resonant elements has the effect of changing the boundary condition at the surface, so that it appears as an artificial magnetic conductor, rather than an electric conductor. It has this property over a bandwidth ranging from a few percent to nearly an octave, depending on the thickness of the structure with respect to the operating wavelength. It is somewhat similar to a corrugated metal surface 22 (see FIG. 1*b*), which has been known to use a resonant structure to transform a short circuit into an open circuit. Quarter wavelength slots 24 of a corrugated surface 22 are replaced with lumped circuit elements in the Hi-Z surface, resulting in a much thinner structure, as is shown in FIG. 1*a*. The Hi-Z surface can be made in various forms, including a multilayer structure with overlapping capacitor plates. Preferably the Hi-Z structure is formed on a printed circuit board (not shown in FIG. 1) with the elements 12 formed on one major surface thereof and the ground plane 14 formed on the other major surface thereof Capacitive loading allows the resonance frequency to be lowered for a given thickness. Operating frequencies ranging from hundreds of megahertz to tens of gigahertz have been demonstrated using a variety of geometries of Hi-Z surfaces.

It has been shown that antennas can be placed directly adjacent the Hi-Z surface and will not be shorted out due to the unusual surface impedance. This is based on the fact that the Hi-Z surface allows a non-zero tangential radio frequency electric field, a condition which is not permitted on an ordinary flat conductor. In one example, a flared notch antenna was placed on a Hi-Z surface, such that the metal shapes making up the antenna are oriented parallel to the surface, as shown in FIG. 2. The antenna exhibits end-fire radiation, in which the radio waves are emitted with the electric field being tangential to the surface, in the form of a leaky TE surface wave.

The radiation pattern for the flared notch antenna on the Hi-Z surface is shown in FIG. 3, along with the pattern for a similar antenna on a flat metal surface. On the Hi-Z surface, the radiation is emitted at 30 degrees to the horizontal, compared to 60 degrees on the metal surface. This suggests that by changing the surface impedance, one can steer a beam in elevation over a range of at least 30 degrees. Tunable impedance surfaces can be made using a variety of mechanical and/or electrostatic techniques, as described in the two patent applications identified above.

It has been determined that the angle at which radiation leaves or is received by an antenna placed about 2.5 cm above a Hi-Z surface depends upon the impedance of the surface. As described in the two U.S. patent applications identified in the immediately preceding paragraph, this surface impedance can be tuned in real time using a variety of techniques. When used with an end-fire array antenna, the antenna can be steered in two dimensions. The antenna is conformable and aerodynamic and can be readily incorporated into the outer skin of an aircraft or other vehicle. Such an antenna can be flush mounted on the exterior walls or rooftops of buildings to provide scanning over a wide angle. Additionally, conformable flush-mounted antennas are useful for automobiles for the reception of cellular signals, personal communication service (PCs) voice and digital data, collision avoidance information, or other data.

In general terms the invention provides a steerable antenna for receiving and/or transmitting a radio frequency wave, the antenna comprising a tunable high impedance surface; and at least one end-fire antenna disposed on said surface.

In another aspect, the invention provides a method of steering a radio frequency wave received by and/or transmitted from an antenna, the method comprising: providing a tunable high impedance surface; disposing at least one end-fire antenna on said surface; and varying the impedance of the tunable high impedance surface.

BRIEF DESCRIPTION OF THE DRAWINGS

FIG. 1*a* is a perspective view of a Hi-Z surface;

FIG. 1*b* is a perspective view of a corrugated surface;

FIG. 1*c* is an equivalent circuit for a resonant element on the Hi-Z surface;

DETAILED DESCRIPTION OF THE INVENTION

Figure 2:
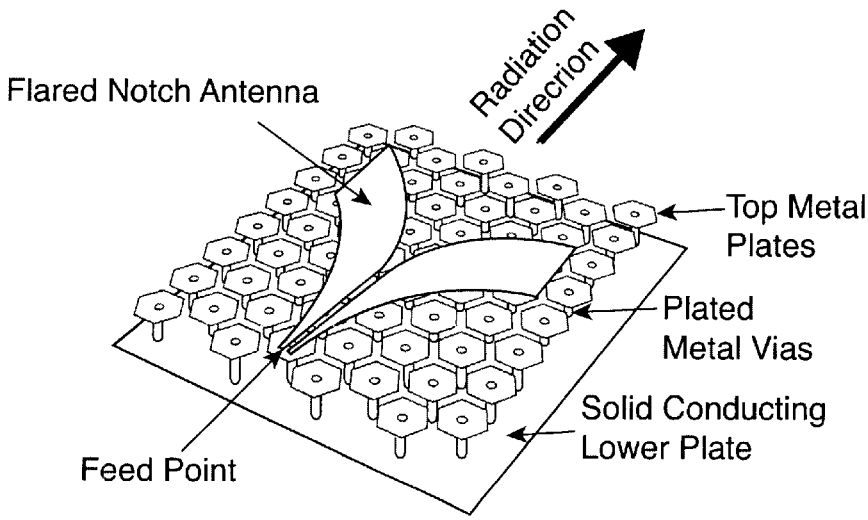
FIG. 2 depicts a flared notch antenna disposed horizontally against a Hi-Z surface.
Figure 3:
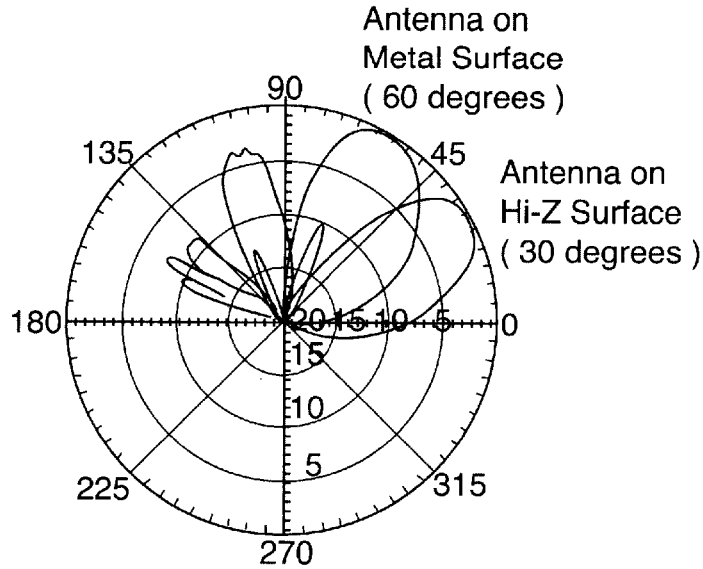
FIG. 3 is a graph of the radiation pattern of an antenna spaced about 2.5 cm above a Hi-Z surface and an antenna spaced about 2.5 cm above a flat metal surface.
Figure 4:
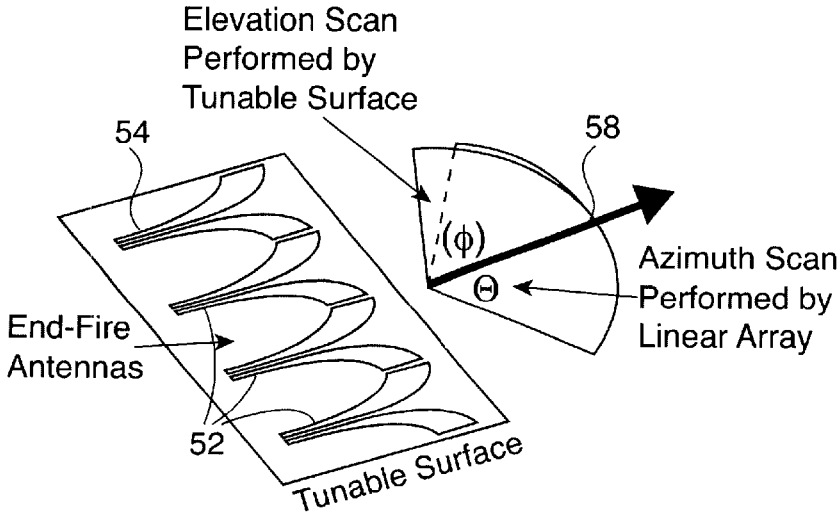
FIG. 4 depicts a flared notch antenna disposed on or adjacent a Hi-Z surface and also depicts a radiated beam being steerable or scannable in both azimuth and elevation.
Figure 5:
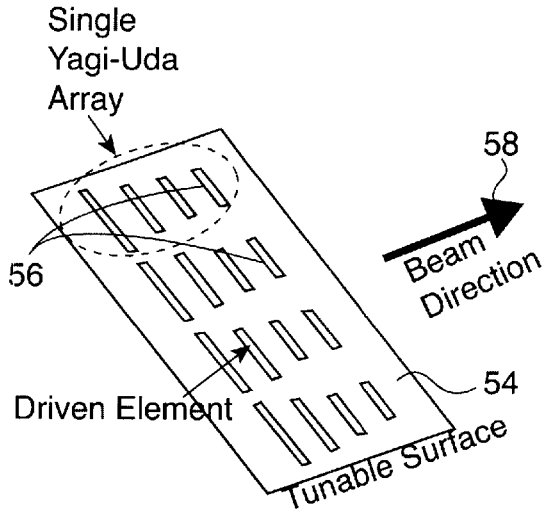
FIG. 5 depicts multiple arrays of Yagi-Uda antenna disposed on or adjacent a Hi-Z surface.

The present invention provides an end-fire antenna or an end-fire antenna array 52 disposed on or adjacent to a tunable impedance surface 54. The tunable surface 54 performs elevation steering, while azimuth steering can be performed by using a conventional phased array. This structure is shown in FIG. 4. Flared notch antennas (one type of end-fire antenna) are shown in this particular embodiment, but other types of end-fire antennas can be used, such as the Yagi-Uda arrays 56 shown in FIG. 5. The antennas are arranged in a line across the surface 54, so that individual antennas may be phased, using techniques known in the art, to provide azimuthal steering of a transmitted or received radio frequency beam 58. The antennas can be arranged in other patterns, if desired, such as a circular geometry, depending upon the available area and steering requirements in the azimuthal angle. Alternatively, a single element can be used if only elevation steering is desired.

The tunable impedance surface 54 can be made to behave as an electric conductor, a magnetic conductor, or anything in between, by using one of several electrostatic or mechanical methods described in the two patent applications noted above, namely, U.S. patent application Ser. No. 09/537,923 entitled "A Tunable Impedance Surface" filed Mar. 29, 2000 and to U.S. patent application Ser. No. 09/537,922 entitled "An Electronically Tunable Reflector" filed Mar. 29,2000.

Experiments indicate that as much as 45 degrees of elevation steering is possible, and even larger angles maybe possible with improved design of the surface or optimization of the antenna elements. The azimuthal steering extent is determined by the properties of the linear array.

The present invention involves an end-fire antenna disposed on a tunable Hi-Z surface in order for the antenna to be provided with elevational steerability. The antenna radiates a beam that exits the Hi-Z surface at an angle and/or receives a beam at an angle to the Hi-Z surface. By tuning the surface impedance of the Hi-Z surface, the angle at which the beam exits or is received by this surface is varied.

Figure 6A:
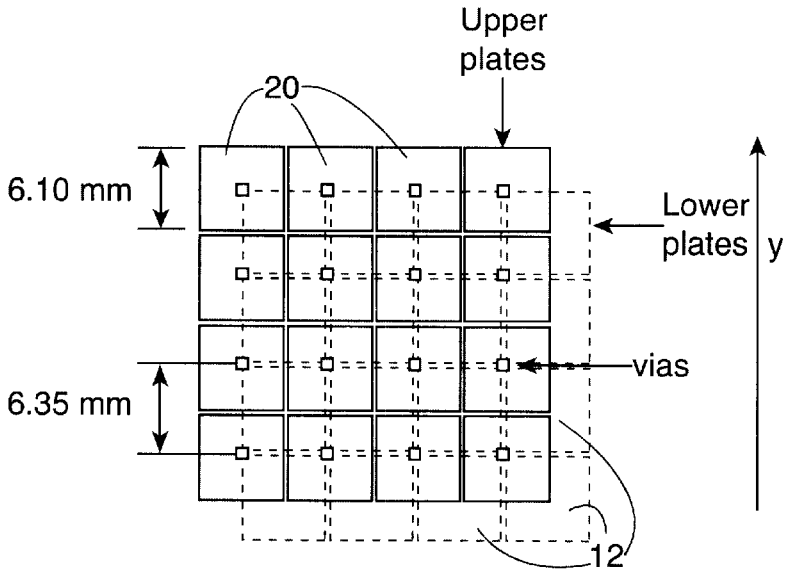
FIGS. 6*a* and 6*b* are plan and side elevation views of a tunable Hi-Z surface comprising a pair of printed circuit boards
Figure 6B:
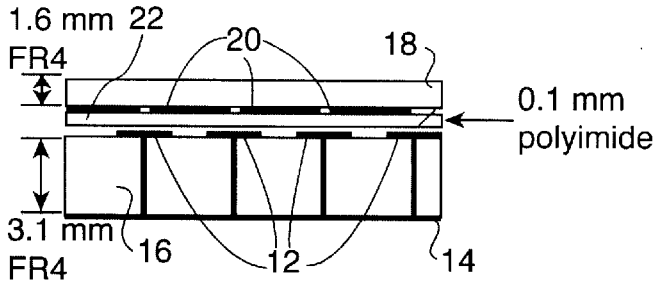

This concept has been tested by constructing a test antenna with a simple tunable Hi-Z surface comprising a pair of printed circuit boards, as shown in FIGS. 6*a* and 6*b*, with a flared notch antenna placed thereagainst. For the test, one of the printed circuit boards 16 was patterned with as a conventional Hi-Z surface having a array of elements 12 formed on one major surface thereof and a ground plane 14 formed on the other major surface thereof. Each metal element 12 in the array was a square-shaped element having a width of 6.10 mm and located in the array with a 6.35 mm center-to-center interval on a 3.1 mm thick printed circuit board made of FR4. The second board 18 contained an array of floating metal plates or elements 20 formed on one major surface thereof, which elements matched the size, shape and distribution of the elements 12 on the Hi-Z surface, but the second array had no ground plane. The two boards were placed adjacent each other in a parallel arrangement so that their metal elements 12 formed a three dimensional array of parallel-plate capacitors with a third printed circuit board 22 acting as the dielectric between the plates of the capacitors. The third printed circuit board was a 0.1 mm thick polyimide plate. By sliding one of the boards with respect to the other board, the capacitances were varied and thus the surface impedance of the Hi-Z surface was likewise varied. In this way the Hi-Z surface was then tuned. In the experiment, the boards were slid nine times in the Y direction by increments of 0.3175 mm, from their initial position shown in FIG. 6*a*. This had this effect of presenting 10 different impedances to a test antenna that was aimed at the top surface of the second board 18.

Figure 6C:
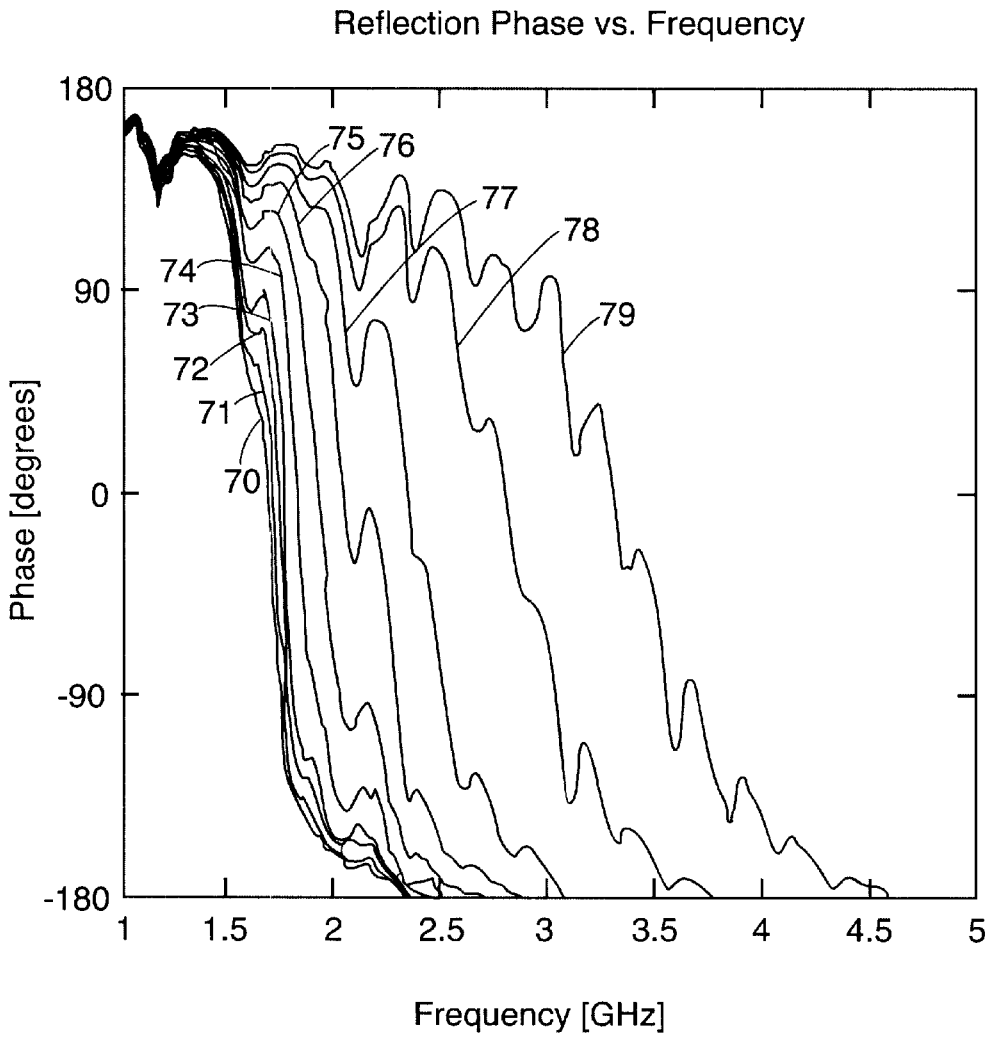
FIG. 6*c* shows the reflection phase measured at normal incidence during a test of a surface comprising the tunable Hi-Z surface of FIGS. 6*a* and 6*c* with a flared notch antenna placed thereagainst.
Figure 7:
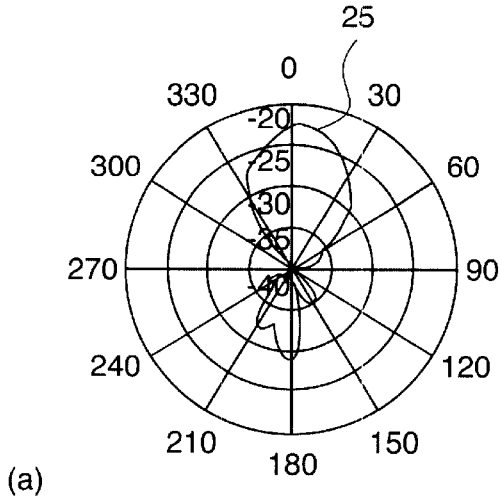
FIGS. 7 through 11 show the radiation pattern of the flared notch antenna placed against the tunable Hi-Z surface during the test.
Figure 8:
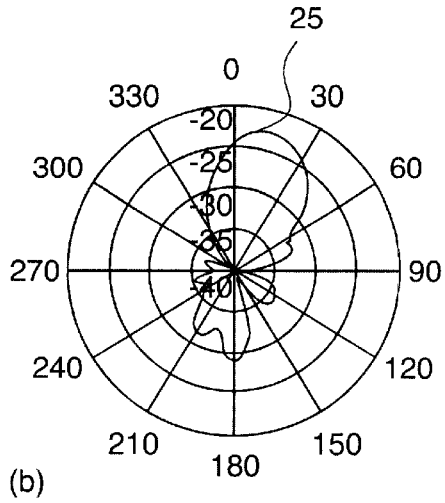
Figure 9:
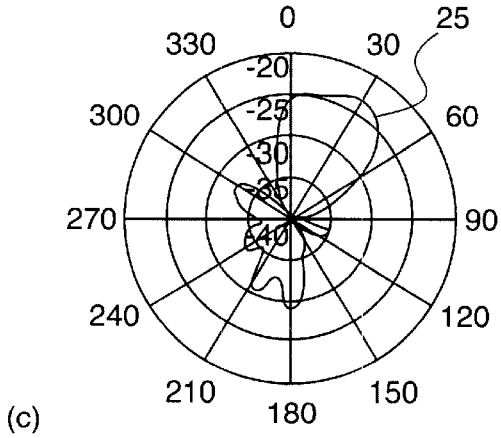
Figure 10:
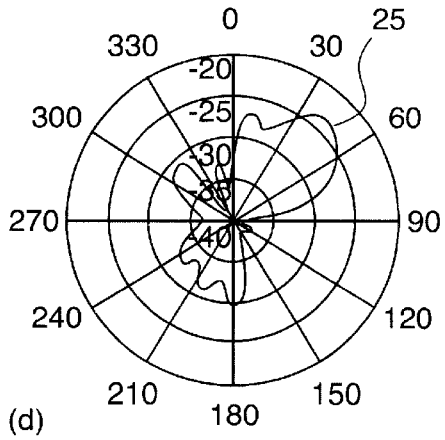
Figure 11:
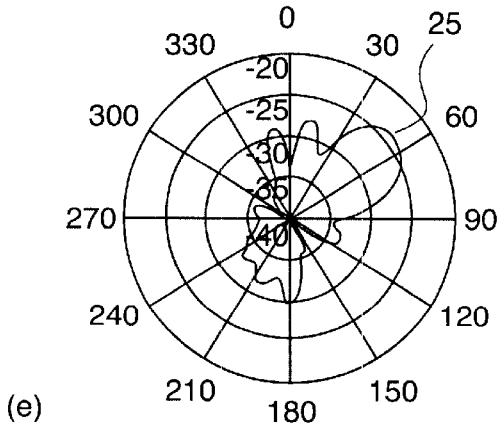

FIG. 6*c* shows the reflection phase of the surface, measured at normal incidence, for the ten relative positions of the two boards 16, 18. Curve 70 corresponds to the initial position of the boards as shown in FIG. 6*a*. Curves 71, 72, 73, 74, 75, 76, 77, 78 and 79 correspond to a relative movement, in the Y direction, of 0.3175 mm, 2×0.3175 mm, 3×0.3175 mm, 4×0.3175 mm, 5×0.3175 mm, 6×0.3175 mm, 7×0.3175, 8×0.3175 mm and 9×0.3175 mm respectively, from the initial position. The reflection phase can be tuned over a range of nearly 180 degrees for this particular geometry. The variations in the reflection phase indicate a change in surface impedance.

FIGS. 7–11 represent radiation patterns for the mechanically tunable Hi-Z surface described above with reference to FIGS. 6*a* and 6*b* with a flared notch antenna disposed on board 18. Each successive figure represents a movement of 80 $\mu$m of the top board 18 relative to the bottom board 16. In this experiment, the initial position was obtained by sliding the boards, relative to each other, by 2.3181 mm in the Y direction, from the position shown in FIG. 6*a*. The radiation pattern of FIG. 7 corresponds to this initial position. FIGS. 8, 9, 10 and 11, correspond to a relative movement, in the Y direction, of 80 $\mu$m, 2×80 $\mu$m, 3×80 $\mu$m and 4×80 $\mu$m respectively. Thus these five successive figures represent a total movement of 320 $\mu$m of the top board 18 relative to the bottom board 16. As can be seen, the main lobe 25 of the RF beam steers by 45 degrees in this test. Thus, as the surface impedance is changed, it can be seen that the elevation angle of the beam also changed.

In the test represented by FIGS. 7–11 a vacuum pump was used to hold the bottom plate 16 snugly against the top plate 18 by applying a suction through holes in plate 16. This effectively eliminated any air space between plates 16 and 18.

Figure 12A:
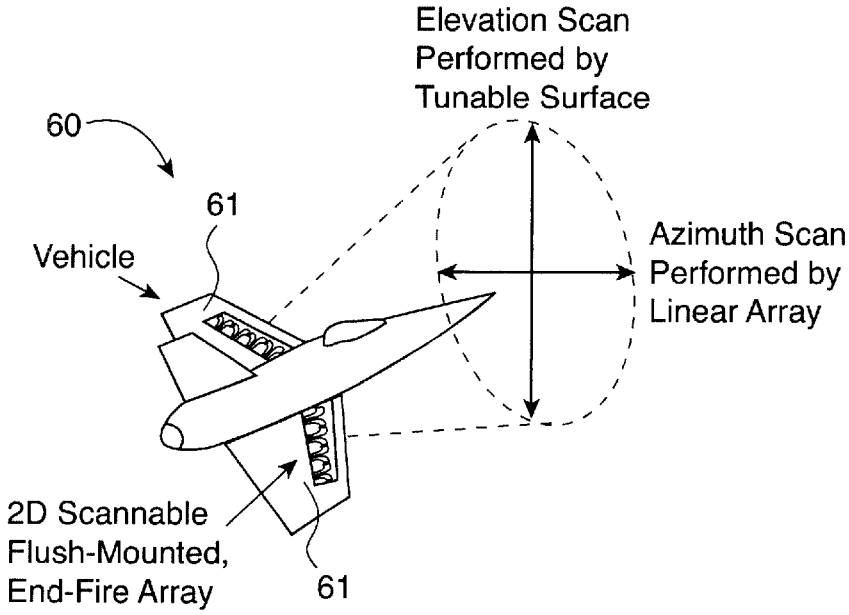
FIGS. 12*a* and 12*b* depict the application of the antenna disclosed herein on flight surfaces of an aircraft.
Figure 12B:
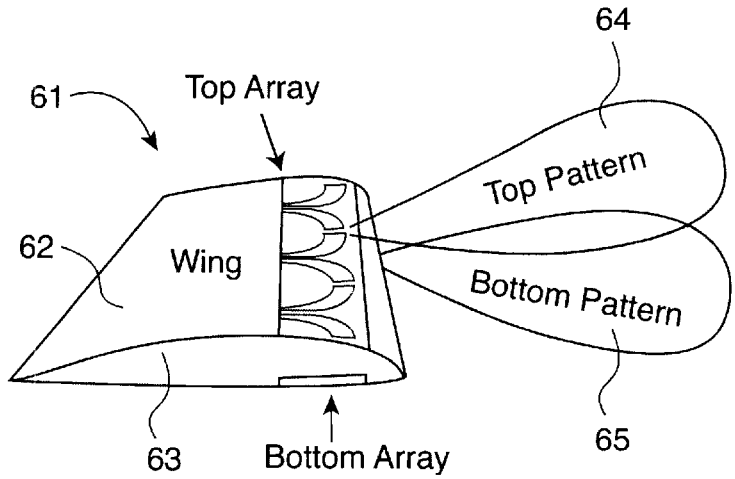

A two-dimensionally steerable, end-fire antenna of the type disclosed herein has uses in a number of applications. For example, since the surface 54 need not be planar, it can conform to the exterior surface of the aircraft wing 61, as shown in FIGS. 12*a* and 12*b*. By mounting antennas in both the upper 62 and lower surfaces 63 of the wing, the combined radio frequency beam can be steered over a wide angle, both above (see numeral 64) and below (see numeral 65) the horizon when the aircraft 60 is flying horizontally. Alternatively, the null formed by the difference of the two signals can be steered, for the accurate tracking of objects.

Figure 13:
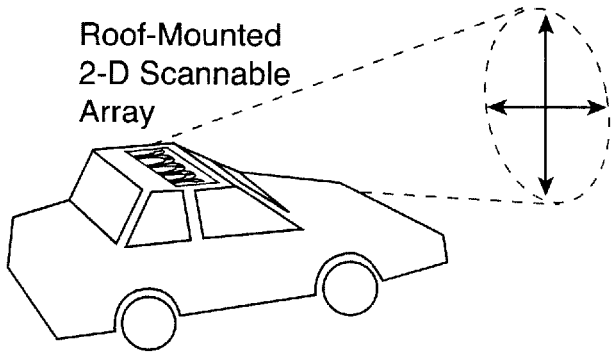
FIG. 13 depicts the application of the antenna disclosed herein on a land vehicle.

Other applications include automotive radar for collision avoidance and active suspension systems, as is illustrated by FIG. 13. Using the two dimensional scanning capability of this antenna, radar systems could distinguish small objects on the road from taller objects, such as other cars or pedestrians. Information from lower angles indicating road hazards can be used to adjust an active suspension system in the vehicle.

Having described this invention in connection with a preferred embodiment, modification will now certainly suggest itself to those skilled in the art. As such, the invention is not to be limited to the disclosed embodiments except as required by the appended claims.

What is claimed is:

1. A steerable antenna for receiving and/or transmitting a radio frequency wave, the antenna comprising:

(a) a tunable high impedance surface; and (b) at least one end-fire antenna disposed on said surface.

2. The steerable antenna of claim 1 wherein the end-fire antenna is a flared notch antenna.

3. The steerable antenna of claim 1 wherein the end-fire antenna is an array of flared notch antennas.

4. The steerable antenna of claim 3 wherein the end-fire antenna is a linear array of flared notch antennas.

5. The steerable antenna of claim 1 wherein the end-fire antenna is a Yagi-Uda antenna.

6. The steerable antenna of claim 1 wherein the end-fire antenna is an array of Yagi-Uda antennas.

7. The steerable antenna of claim 6 wherein the end-fire antenna is a linear array Yagi-Uda antennas.

8. The steerable antenna of claim 1 wherein the tunable high impedance surface comprises at least two relatively moveable insulating substrates, a first one of said at least two relatively moveable insulating substrates having an array of elements disposed on a major surface thereof and a ground plane disposed on another major surface thereof, a second one of said at least two relatively moveable insulating substrates having an array of elements disposed thereon, the array of elements on the second one of said at least two relatively moveable insulating substrates confronting the array of elements on the first one of said at least two relatively moveable insulating substrates through the second one of said at least two relatively moveable insulating substrates.

9. The steerable antenna of claim 8 wherein two relatively moveable insulating substrates each has a thickness which is less than the wavelength of said radio frequency wave.

10. The steerable antenna of claim 9 wherein the elements forming the array of elements disposed on the two relatively moveable insulating substrates each have a maximum dimension which is less than the wavelength of said radio frequency wave.

11. The steerable antenna of claim 1 wherein the tunable high impedance surface includes an insulating substrate having an array of elements disposed on a major surface thereof and a ground plane disposed on another major surface thereof and a capacitor arrangement for controllably varying the capacitance of adjacent elements of said array.

12. A method of steering a radio frequency wave, received by and/or transmitted from an antenna, the method comprising:

(a) providing a tunable high impedance surface;

(b) disposing at least one end-fire antenna on said surface; and (c) varying the impedance of the tunable high impedance surface.

13. The method of claim 12 wherein the end-fire antenna is a flared notch antenna.

14. The method of claim 12 wherein the end-fire antenna is an array of flared notch antennas.

15. The method of claim 14 wherein the end-fire antenna is a linear array of flared notch antennas.

16. The method of claim 12 wherein the end-fire antenna is a Yagi-Uda antenna.

17. The method of claim 12 wherein the end-fire antenna is an array of Yagi-Uda antennas.

18. The method of claim 17 wherein the end-fire antenna is a linear array Yagi-Uda antennas.

19. The method of claim 12 wherein the tunable high impedance surface comprises at least two relatively moveable insulating substrates, a first one of said at least two relatively moveable insulating substrates having an array of elements disposed on a major surface thereof and a ground plane disposed on another major surface thereof, a second one of said at least two relatively moveable insulating substrates having an array of elements disposed thereon, the array of elements on the second one of said at least two relatively moveable insulating substrates confronting the array of elements on the first one of said at least two relatively moveable insulating substrates through the second one of said at least two relatively moveable insulating substrates and wherein the step of varying the impedance of the tunable high impedance surface comprises moving the first and second insulating substrates relative to each other.

20. The method of claim 19 wherein two relatively moveable insulating substrates each has a thickness which is less than the wavelength of said radio frequency wave.

21. The method of claim 20 wherein the elements forming the array of elements disposed on the two relatively moveable insulating substrates each have a maximum dimension which is less than the wavelength of said radio frequency wave.

22. The method of claim 12 wherein the tunable high impedance surface includes an insulating substrate having an array of elements disposed on a major surface thereof and a ground plane disposed on another major surface thereof and capacitor arrangement for controllably varying the capacitance of adjacent elements of said array and wherein the step of varying the impedance of the tunable high impedance surface comprises varying the capacitance of adjacent elements of said array.

23. A steerable antenna for transmitting a radio frequency beam, the antenna comprising:

(a) a tunable impedance surface;

(b) at least one end-fire antenna disposed on said surface; and (c) means for tuning the impedance of the tunable impedance surface to control the take off angle of the radio frequency beam relative to the tunable impedance surface.

24. The steerable antenna of claim 23 wherein the end-fire antenna is a flared notch antenna.

25. The steerable antenna of claim 23 wherein the end-fire antenna is an array of flared notch antennas.

26. The steerable antenna of claim 25 wherein the end-fire antenna is a linear array of flared notch antennas.

27. The steerable antenna of claim 23 wherein the end-fire antenna is a Yagi-Uda antenna.

28. The steerable antenna of claim 23 wherein the end-fire antenna is an array of Yagi-Uda antennas.

29. The steerable antenna of claim 28 wherein the end-fire antenna is a linear array Yagi-Uda antennas.

30. The steerable antenna of claim 23 wherein the tunable impedance surface comprises at least two relatively moveable insulating substrates, a first one of said at least two relatively moveable insulating substrates having an array of elements disposed on a major surface thereof and a ground plane disposed on another major surface thereof, a second one of said at least two relatively moveable insulating substrates having an array of elements disposed thereon, the array of elements on the second one of said at least two relatively moveable insulating substrates confronting the array of elements on the first one of said at least two relatively moveable insulating substrates through the second one of said at least two relatively moveable insulating substrates.

31. The steerable antenna of claim 30 wherein the means for tuning is mechanical means for moving the two relatively movable insulating substrates relative to each other.

32. The steerable antenna of claim 30 wherein two relatively moveable insulating substrates each has a thickness which is less than the wavelength of said radio frequency wave.

33. The steerable antenna of claim 32 wherein the elements forming the array of elements disposed on the two relatively moveable insulating substrates each have a maximum dimension which is less than the wavelength of said radio frequency wave.

34. The steerable antenna of claim 23 wherein the tunable impedance surface includes an insulating substrate having an array of elements disposed on a major surface thereof and a ground plane disposed on another major surface thereof and a capacitor arrangement for controllably varying the capacitance of adjacent elements of said array.

35. A steerable antenna system for receiving a radio frequency wave, the antenna system comprising:

(a) a tunable impedance surface;

(b) at least one end-fire antenna disposed on said surface; and (c) means for tuning the impedance of the tunable impedance surface to control the sensitivity of the end fire antenna to radio frequency waves in an elevation direction relative to the tunable impedance surface.

36. The steerable antenna of claim 35 wherein the end-fire antenna is a flared notch antenna.

37. The steerable antenna of claim 35 wherein the end-fire antenna is an array of flared notch antennas.

38. The steerable antenna of claim 37 wherein the end-fire antenna is a linear array of flared notch antennas.

39. The steerable antenna of claim 35 wherein the end-fire antenna is a Yagi-Uda antenna.

40. The steerable antenna of claim 35 wherein the end-fire antenna is an array of Yagi-Uda antennas.

41. The steerable antenna of claim 40 wherein the end-fire antenna is a linear array Yagi-Uda antennas.

42. The steerable antenna of claim 35 wherein the tunable impedance surface comprises at least two relatively moveable insulating substrates, a first one of said at least two relatively moveable insulating substrates having an array of elements disposed on a major surface thereof and a ground plane disposed on another major surface thereof, a second one of said at least two relatively moveable insulating substrates having an array of elements disposed thereon, the array of elements on the second one of said at least two relatively moveable insulating substrates confronting the array of elements on the first one of said at least two relatively moveable insulating substrates through the second one of said at least two relatively moveable insulating substrates.

43. The steerable antenna of claim 42 wherein the mean for tuning is mechanical means for moving the two relatively movable insulating substrates relative to each other.

44. The steerable antenna of claim 42 wherein two relatively moveable insulating substrates each has a thickness which is less than the wavelength of said radio frequency wave.

45. The steerable antenna of claim 44 wherein the elements forming the array of elements disposed on the two relatively moveable insulating substrates each have a maximum dimension which is less than the wavelength of said radio frequency wave.

46. The steerable antenna of claim 35 wherein the tunable impedance surface includes an insulating substrate having an array of elements disposed on a major surface thereof and a ground plane disposed on another major surface thereof and a capacitor arrangement for controllably varying the capacitance of adjacent elements of said array.

47. A method of steering the sensitivity of an end-fire antenna to a received radio frequency wave, the method comprising:

(a) providing a tunable impedance surface;

(b) disposing at least one end-fire antenna disposed on said surface; and (c) controllably varying the impedance of the tunable impedance surface to thereby affect the sensitivity of the end fire antenna in an elevation direction relative to said tunable impedance surface.

48. The method of claim 47 wherein the end-fire antenna is a flared notch antenna.

49. The method of claim 47 wherein the end-fire antenna is an array of flared notch antennas.

50. The method of claim 49 wherein the end-fire antenna is a linear array of flared notch antennas.

51. The method of claim 47 wherein the end-fire antenna is a Yagi-Uda antenna.

52. The method of claim 47 wherein the end-fire antenna is an array of Yagi-Uda antennas.

53. The method of claim 52 wherein the end-fire antenna is a linear array Yagi-Uda antennas.

54. The method of claim 47 wherein the tunable impedance surface comprises at least two relatively moveable insulating substrates, a first one of said at least two relatively moveable insulating substrates having an array of elements disposed on a major surface thereof and a ground plane disposed on another major surface thereof, a second one of said at least two relatively moveable insulating substrates having an array of elements disposed thereon, the array of elements on the second one of said at least two relatively moveable insulating substrates confronting the array of elements on the first one of said at least two relatively moveable insulating substrates through the second one of said at least two relatively moveable insulating substrates an wherein the step of varying the impedance of the tunable impedance surface comprises moving the first and second insulating substrates relative to each other.

55. The method of claim 54 wherein two relatively moveable insulating substrates each have a thickness which is less than the wavelength of said radio frequency wave.

56. The method of claim 55 wherein the elements forming the array of elements disposed on the two relatively moveable insulating substrates each having a maximum dimension which is less than the wavelength of said radio frequency wave.

57. The method of claim 47 wherein the tunable impedance surface includes an insulating substrate having an array of elements disposed on a major surface thereof and a ground plane disposed on another major surface thereof and capacitor arrangement for controllably varying the capacitance of adjacent elements of said array and wherein the step of varying the impedance of the tunable impedance surface comprises varying the capacitance of adjacent elements of said array.

58. A method of steering the sensitivity of an end-fire antenna to a received radio frequency wave, the method comprising:

(a) providing a tunable impedance surface;

(b) disposing at least one end-fire antenna disposed on said surface; and (c) controllably varying the impedance of the tunable impedance surface to thereby affect the sensitivity of the end fire antenna in an elevation direction relative to said tunable impedance surface.

59. The method of claim 58 wherein the end-fire antenna is a flared notch antenna.

60. The method of claim 58 wherein the end-fire antenna is an array of flared notch antennas.

61. The method of claim 60 wherein the end-fire antenna is a linear array of flared notch antennas.

62. The method of claim 58 wherein the end-fire antenna is a Yagi-Uda antenna.

63. The method of claim 58 wherein the end-fire antenna is an array of Yagi-Uda antennas.

64. The method of claim 63 wherein the end-fire antenna is a linear array Yagi-Uda antennas.

65. The method of claim 58 wherein the tunable impedance surface comprises at least two relatively moveable insulating substrates, a first one of said at least two relatively moveable insulating substrates having an array of elements disposed on a major surface thereof and a ground plane disposed on another major surface thereof, a second one of said at least two relatively moveable insulating substrates having an array of elements disposed thereon, the array of elements on the second one of said at least two relatively moveable insulating substrates confronting the array of elements on the first one of said at least two relatively moveable insulating substrates through the second one of said at least two relatively moveable insulating substrates an wherein the step of varying the impedance of the tunable impedance surface comprises moving the first and second insulating substrates relative to each other.

66. The method of claim 65 wherein two relatively moveable insulating substrates each have a thickness which is less than the wavelength of said radio frequency wave.

67. The method of claim 66 wherein the elements forming the array of elements disposed on the two relatively moveable insulating substrates each have a maximum dimension which is less than the wavelength of said radio frequency wave.

68. The method of claim 58 wherein the tunable impedance surface includes an insulating substrate having an array of elements disposed on a major surface thereof and a ground plane disposed on another major surface thereof and capacitor arrangement for controllably varying the capacitance of adjacent elements of said array and wherein the step of varying the impedance of the tunable impedance surface comprises varying the capacitance of adjacent elements of said array.

* * * * *